US007284932B2

(12) United States Patent
Meisenbichler et al.

(10) Patent No.: US 7,284,932 B2
(45) Date of Patent: Oct. 23, 2007

(54) PRESSING-OUT APPARATUS

(75) Inventors: Karl Meisenbichler, Muerzhofen (AT); Christof Radl, Hohenems (AT)

(73) Assignee: Hilti Aktiengeselischaft, Schaan (LI)

( * ) Notice: Subject to any disclaimer, the term of this patent is extended or adjusted under 35 U.S.C. 154(b) by 309 days.

(21) Appl. No.: 10/898,880

(22) Filed: Jul. 26, 2004

(65) Prior Publication Data

US 2005/0084339 A1 Apr. 21, 2005

(30) Foreign Application Priority Data

Jul. 28, 2003 (DE) ..... 103 34 374

(51) Int. Cl.
*E21D 20/02* (2006.01)

(52) U.S. Cl. ..... 405/259.5; 405/269

(58) Field of Classification Search ..... 405/269, 405/259.5, 259.6

See application file for complete search history.

(56) References Cited

U.S. PATENT DOCUMENTS

| | | | | |
|---|---|---|---|---|
| 4,055,051 | A | 10/1977 | Finney | |
| 6,457,910 | B1 * | 10/2002 | Ludwig et al. | 405/259.1 |
| 6,468,010 | B2 * | 10/2002 | Sager et al. | 405/259.5 |
| 6,491,478 | B2 * | 12/2002 | Sager et al. | 405/259.6 |

FOREIGN PATENT DOCUMENTS

| | | |
|---|---|---|
| DE | 3838186 | 5/1989 |
| DE | 0017763 | 10/2001 |
| DE | 0058385 | 6/2002 |

* cited by examiner

*Primary Examiner*—Frederick L. Lagman
(74) *Attorney, Agent, or Firm*—Abelman, Frayne & Schwab

(57) ABSTRACT

A pressing-out apparatus (4) for pressing out a mass from a self-drilling, chemical composite anchor (2) for mining and tunnel construction has a pressing device arranged in a housing (21). The composite anchor (2) includes an anchor tube (5) having one end (6) with a drilling head (7) and one free end (8) and can be drilled into the receiving material by means of a motor (3). The pressing-out apparatus (4) is operatively coupled with the motor (3) and with the free end (8) of the anchor tube (5).

10 Claims, 3 Drawing Sheets

PRESSING-OUT APPARATUS

BACKGROUND OF THE INVENTION

The invention is directed to an apparatus for pressing out a mass from a self-drilling, chemical composite anchor for the construction field, particularly for pressing out a mass from a self-drilling, chemical composite anchor for mining and tunnel construction. The apparatus has a housing enclosing a pressing device. The composite anchor has an anchor tube with a drilling head at a leading end and a trailing end within an outer housing. The anchor tube can be drilled into a receiving material by means of a motor. The anchor tube has a receptacle for the mass to be pressed out and a piston can be arranged in the anchor tube for forcing out the mass. The invention is further directed to an arrangement with an apparatus of the type mentioned above.

DESCRIPTION OF THE PRIOR ART

Chemical composite anchors for use in the construction industry and particularly for the mining and tunneling fields have been known for a long time. They are used primarily for stabilizing excavations or walls in hollow spaces such as tunnels, galleries and the like. When excavations and hollow spaces are made, the mechanical characteristics and particularly the load bearing capacity of the rock strata are reduced. These rock strata are anchored by means of chemical composite anchors to unimpaired rock strata farther away and accordingly are secured to the latter.

DE 100 17 763 A1 discloses a chemical composite anchor having an anchor tube with a drilling head and load application means for a drilling device. A receptacle for a mass to be pressed out, the mass itself, and a pressing-out piston are provided in the tubular member. In a first step, the composite anchor is drilled into the substrate by the drilling device. In a further step, a pressing-out or dispensing apparatus is arranged at the load application means after removing the drilling device and the mass is pressed out in the direction of the drilling head by a pressing-out mechanism comprising, for example, a plunger and a piston rod. The mass penetrates into the bore hole base and into the annular gap between the bore hole wall and the anchor tube through the outlet openings at the drilling head. After the mass has hardened, the composite anchor is anchored in the substrate or receiving material.

The known solution is disadvantageous in that the removal of the drilling device and assembly of the pressing-out apparatus represent a considerable expenditure, particularly in mining and tunnel construction. In addition, there is only limited space particularly in mining and tunnel construction, so that the pressing out of the mass is impeded or rendered impossible with long composite anchors.

SUMMARY OF THE INVENTION

It is the object of the invention to provide an apparatus and an arrangement which can be assembled simply and which has a small space requirement while also ensuring large pressing-out lengths.

This object is met through the features of the independent claim. Advantageous further developments are indicated in the subclaims.

The apparatus for pressing out the mass according to the invention is coupled to the free end of the anchor tube prior to the start of the drilling process. The motor of a drilling device is coupled to the apparatus. The apparatus for pressing out the mass has torque driving. During the drilling process, the apparatus can turn along with the anchor tube until the desired drilling depth is reached. When the drilling process is concluded, the mass is pressed out by the apparatus by means of a pressing-out piston. The mass to be pressed out is, for example, a multicomponent mass which has been introduced in a foil bag into a receptacle in the anchor tube before the start of the drilling process. After the pressing-out operation, the motor is uncoupled from the apparatus and the apparatus is uncoupled from the free end of the anchor tube. The pressing-out apparatus is available for further use for pressing out or dispensing a mass to be pressed out in another composite anchor.

In another embodiment of the pressing-out apparatus described above, the apparatus according to the invention is fixedly connected to the motor as a unit or is fixedly connected to the drilling device as a unit. With this construction of the invention, the assembly and disassembly effort is additionally reduced in every composite anchor to be placed.

The pressing-out apparatus preferably has a rotatably mounted rotor part in the housing. The rotor part is operatively coupled to the motor and to the free end of the anchor tube. The rotor part accomplishes the torque driving of the apparatus. In this embodiment, the housing remains in its position during the drilling operation. Accordingly, any connections or supports, for example, can be arranged at the housing of the pressing-out apparatus without hindering the drilling process, e.g., as a result of such connections or supports being wrapped around the pressing-out apparatus. The rotor part is mounted in the housing by means of ball bearings which are preferably hermetically sealed so as to prevent the two parts from jamming together during the drilling operation. In a variation of this embodiment, the contact surfaces between the housing and the rotor part, for example, are provided with a sliding coating, such as a Teflon coating.

The pressing device is preferably arranged inside the rotor part. The pressing device is, for example, fixedly connected to the rotor part and rotates with it during the drilling operation. In a variation of this construction, the pressing device is rotatably mounted in the rotor part. Since the working direction of the pressing device in this construction lies approximately in the setting direction of the composite anchor, the pressing pressure generated by the pressing device acts on the pressing-out piston in the anchor tube without any force-diminishing deflection.

The pressing device is advantageously actuated by a fluid medium. Since there is no arrangement of a mechanism for pressing out the mass, the pressing-out apparatus can be constructed in a compact manner with small overall dimensions. The space-saving construction makes it possible to use composite anchors in hollow spaces in which, because of the limited space available, it was previously possible to press out composite anchors, if at all, only conditionally due to the space requirement of the previous pressing-out apparatus. Further, the pressing-out apparatus according to the invention comprises a small quantity of moving parts, which is advantageous with respect to service life and maintenance. In addition, no part of the mass to be pressed out can adhere in front of or behind the pressing-out piston, which represents a distinct advantage over mechanical pressing-out devices. Further, in contrast to mechanical systems, contact between the user and the sometimes corrosive constituents of the mass to be pressed out is extensively excluded. Water is preferably used as the fluid medium. Other fluid media suitable for actuating the pressing device include compressed air, hydraulic oil and the like.

To guide the fluid medium, the pressing device has an inlet opening, an intermediate channel and an outlet opening for the fluid medium. The fluid medium is guided from a connection through the inlet opening, the intermediate channel and the outlet opening in such a way that the fluid medium acts essentially perpendicular to the pressing-out piston arranged in the anchor tube. At the conclusion of the drilling operation, a valve is opened, for example, which allows the fluid medium that is under pressure to enter the pressing device. The fluid medium strikes the pressing-out piston which is displaced in the setting direction of the composite anchor due to the pressure buildup. After the predetermined amount of mass to be pressed out has been dispensed, the valve is closed and the pressing-out apparatus is removed from the anchor tube of the composite anchor.

The intermediate channel and the outlet opening preferably lie substantially on an axis which advantageously extends substantially parallel to the setting direction of the composite anchor. The inlet opening is oriented substantially radially outward. Owing to this guiding of the fluid medium, the pressing-out apparatus can be dimensioned in a compact manner. The inlet opening is preferably oriented with respect to the above-mentioned axis, or with respect to the setting direction of the composite anchor, so as to be at an angle of 90° relative to the latter.

The pressing device preferably has a mandrel which can be inserted into the receptacle of the anchor tube. The receptacle of the anchor tube is, for example, the inner wall of the anchor tube or the inner wall of an inner tube arranged in the anchor tube. The fluid medium is supplied to the pressing-out piston in a flawless manner. The mandrel is preferably formed in the area of the outlet opening of the pressing device.

Sealing means is advantageously provided at the mandrel for creating a tight connection between the mandrel and the receptacle of the anchor tube. The sealing means is, for example, a sealing ring made of rubber, which prevents the fluid medium acting on the pressing-out piston from exiting opposite to the setting direction of the composite anchor. In a particularly preferable manner, the sealing means is formed at the interface between the pressing device and the anchor tube as a high-pressure seal at the mandrel of the pressing device and/or at the receptacle of the anchor tube which can withstand the high pressure of the fluid medium acting on the pressing-out piston.

A connection opening which can be made to communicate with the inlet opening of the pressing device is advantageously formed at the housing of the pressing-out apparatus. The connection opening at the housing has, for example, a hose connection to which a hose carrying the fluid medium can be connected. To facilitate and accelerate the assembly and disassembly of the pressing-out apparatus and the drilling device that is used, the connection is provided, for example, with a quick-acting connection and/or adapter. A plurality of openings or an annular channel, for example, are provided in the rotor part and enable a connection to the inlet opening in the pressing device and to the connection opening at the housing so that the fluid medium is supplied to the pressing device in different positions of the rotor part.

The pressing-out apparatus preferably has a pressure relief valve. When the movement of the pressing-out piston in the setting direction of the composite anchor is impeded or stopped, the pressure in the fluid medium can be reduced by means of the pressure relief valve before the pressing-out apparatus and possibly the drilling device are damaged.

The pressing-out apparatus preferably has a removal channel in the rotor part for carrying off drillings developed during the drilling operation of the composite anchor. A removal channel is likewise preferably provided in the pressing device for carrying off drillings developed during the drilling operation of the composite anchor. During a drilling process using the dry method, any drillings that occur can be sucked out through the removal channel. During a drilling process using the wet method, the necessary flushing water can be supplied and removed through the removal channel.

The arrangement for setting a self-drilling, chemical composite anchor in the construction field, particularly for setting a self-drilling, chemical composite anchor in mining and tunnel construction, comprises a motor by which the composite anchor is drilled into the receiving material and a pressing-out apparatus according to the invention. The arrangement requires less effort on assembly and disassembly compared to the known arrangements because it is not necessary to uncouple the drilling device from the anchor tube before the mass to be pressed out can be dispensed from the anchor tube. In addition, the arrangement requires less space.

The arrangement preferably has a storage vessel for replenishing the fluid medium for actuating the pressing device. During the pressing out operation, the required amount of fluid medium is provided in the storage vessel and is preferably guided back into the storage vessel after the pressing out operation and is stored therein until the next use of the arrangement. Instead of a separate storage vessel, a line system for the fluid medium can serve as a storage vessel. For example, when water is used as fluid medium, the water line and a drain line, if any is provided, can take over the function of the storage vessel.

The arrangement preferably has a controlled pressure cylinder for actuating the pressing device. The fluid medium can also be made to dispense the mass to be pressed out under the most confined spatial conditions at the desired or required level of pressure by means of the pressure cylinder which is operated, for instance, hydraulically or pneumatically. When water is used as fluid medium, pressure is to be generated around $2*10^7$ Pa. When the arrangement has a storage vessel, the latter is preferably connected upstream of the pressure cylinder. In an advantageous manner, a water column which is free of air is provided between the storage vessel and the connection to the pressing-out apparatus.

One of the most substantial advantages is the ability to continuously regulate the pressing-out apparatus according to the invention. Accordingly, different anchor lengths, different materials of the mass to be pressed out and different annular gap conditions can be accounted for by one and the same pressing-out apparatus.

Further advantageous embodiment forms and combinations of features of the invention follow from the detailed description and from the patent claims in their entirety.

BRIEF DESCRIPTION OF THE DRAWINGS

The invention is described more fully in the following with reference to an embodiment in which.

Identical parts are generally designated by identical reference numbers in the drawings.

DETAILED DESCRIPTION OF THE INVENTION

Figure 1:
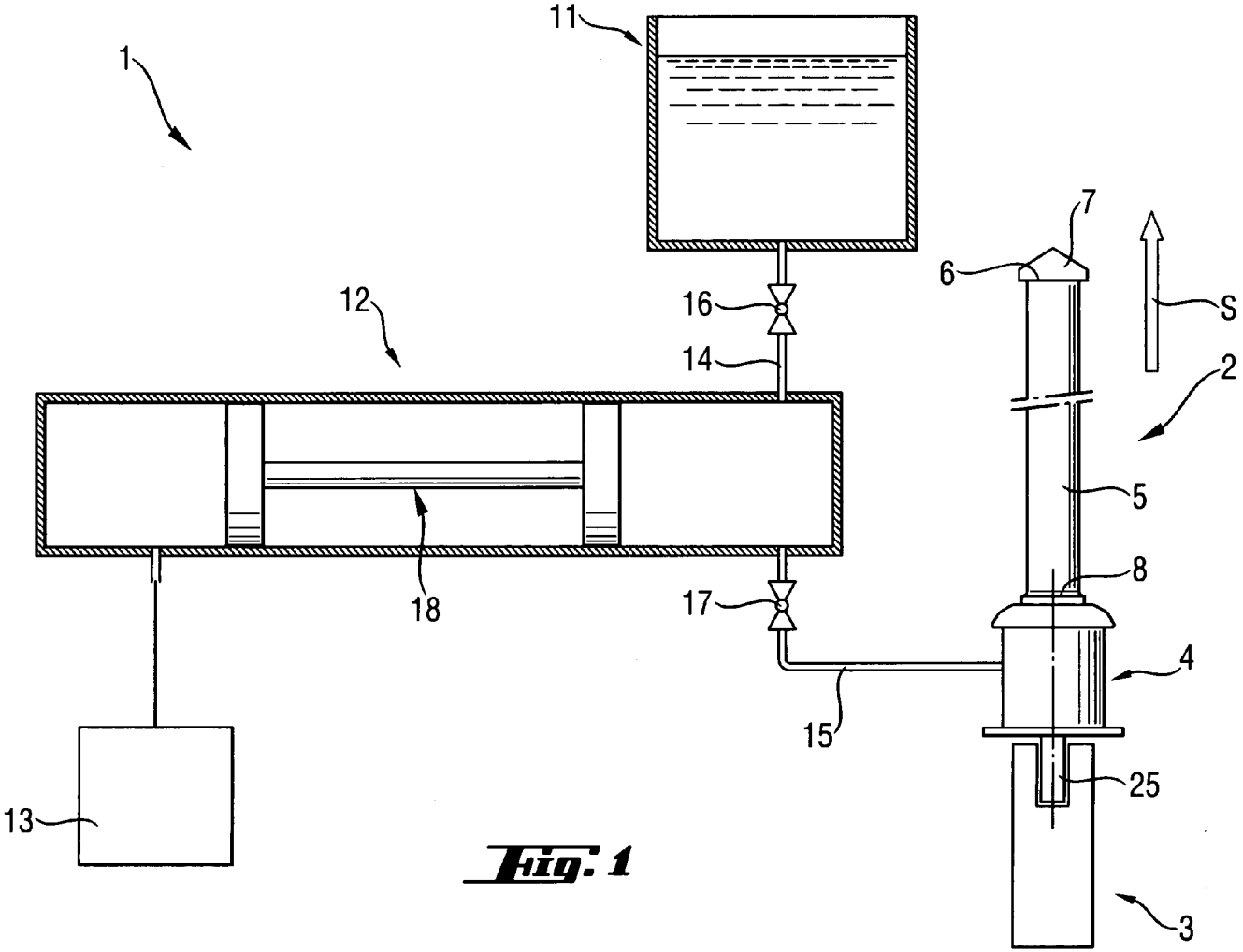
FIG. 1 shows a schematic arrangement of the pressing-out apparatus according to the invention.

A schematic arrangement including the pressing-out apparatus according to the invention is shown in FIG. 1. The arrangement 1 for setting a self-drilling, chemical composite anchor 2 in a receiving material comprises a motor 3 and a pressing-out apparatus 4 which can be actuated by a fluid medium. In this embodiment, water is used as the fluid medium.

The composite anchor 2 has an axially extending anchor tube 5. A drilling head 7 with outlet openings for a mass to be pressed out is arranged at the leading end of the anchor tube 5 situated in the setting direction S. Before the start of the drilling process, the pressing-out apparatus 4 is coupled to the trailing end 8 of the anchor tube 5 and the motor 3 of a drilling device is subsequently connected and operatively coupled to the pressing-out apparatus 4. At the conclusion of the drilling process, the pressing-out apparatus 4 is actuated and the mass in the anchor tube 5 of the composite anchor 2 is dispensed. At the conclusion of the pressing out operation, the pressing-out apparatus 4 with the motor 3 is uncoupled from the anchor tube 5 and is ready to be used for setting another self-drilling, chemical composite anchor.

The arrangement 1 further comprises a water tank as a storage vessel 11 and a hydraulic pressure cylinder 12 which is controlled by a control unit 13. A shutoff valve 16 and 17, respectively, is arranged in the connection lines 14 and 15. In the pressure cylinder 12, the water is pressurized to a pressure of about $2*10^7$ Pa through the displacement of the push-out unit 18 to dispense the mass in the anchor tube 5 out of pressing-out apparatus 4. At the conclusion of the pressing out operation, the push-out unit 18 in the pressure cylinder can be moved back so that the water that was previously required is guided back into the storage vessel 11. The shutoff valves 16 and 17 prevent the water located in the storage tank 11 or in the pressure cylinder 12 from running out when the arrangement, or parts thereof, is modified or relocated.

Figure 2:
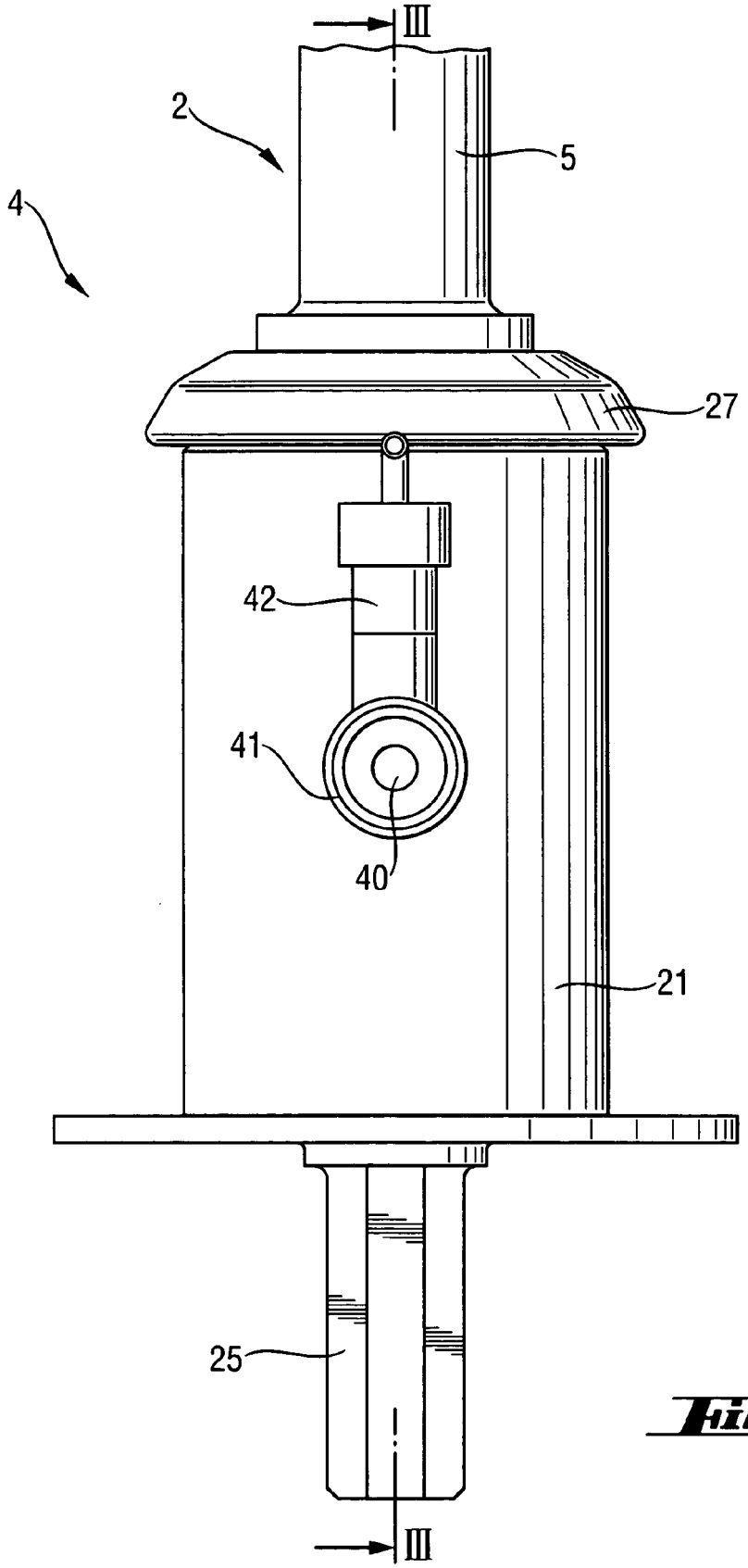
FIG. 2 is a view of the pressing-out apparatus according to the invention.
Figure 3:
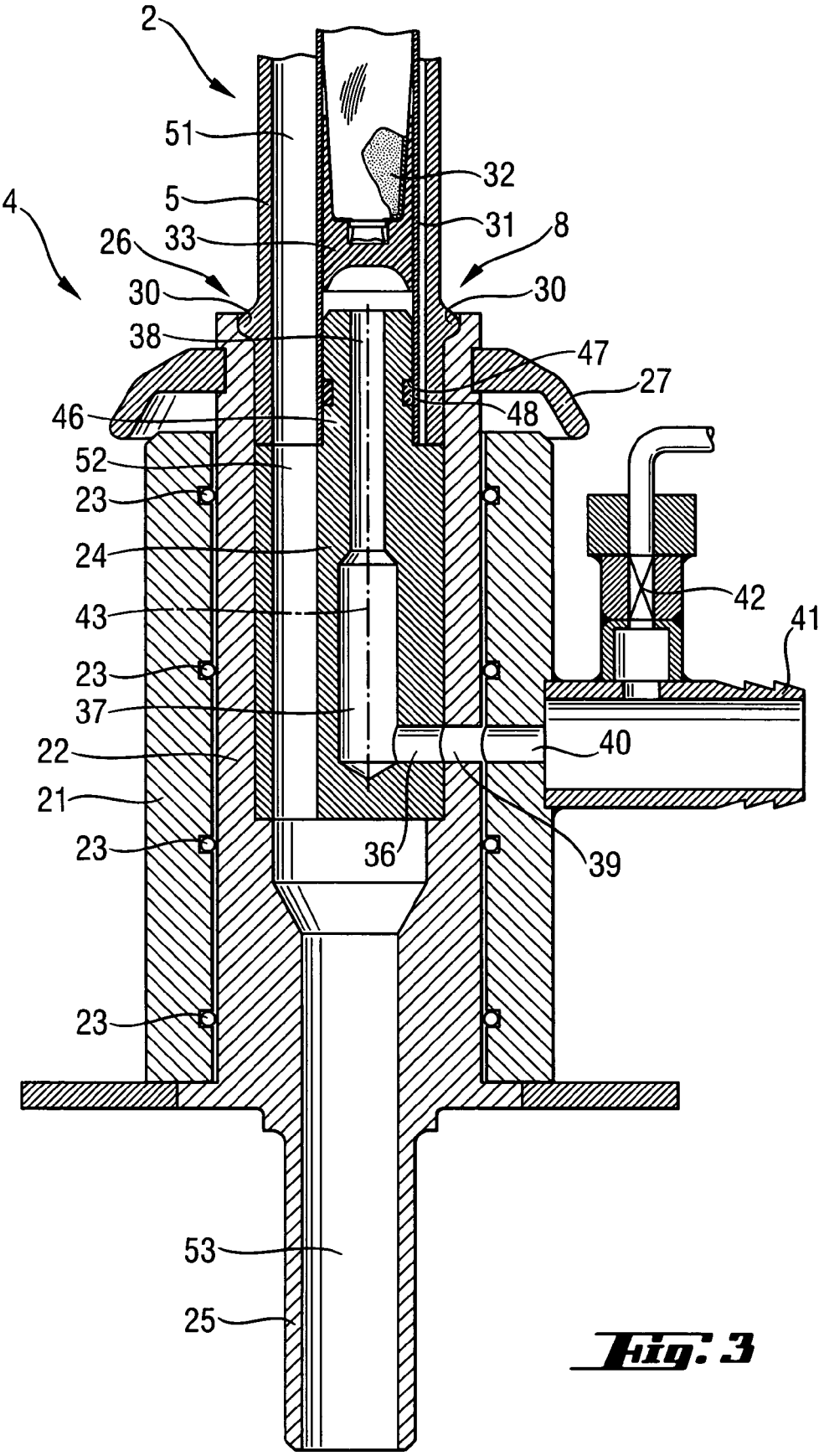
FIG. 3 shows a longitudinal section through the pressing-out apparatus according to the invention taken along line III-III in FIG. 2.

The pressing-out apparatus 4 according to FIGS. 2 and 3 has a sleeve-shaped housing 21 in which a rotor part 22 is arranged and is rotatably mounted on a plurality of ball bearings 23 in the housing 21. A pressing device 24 is provided at the upper end of the rotor part 22 and is connected to the rotor part 22. A cover 27 is arranged near the upper end of the rotor part 22 and reduces the amount of dust and drillings that could penetrate into the gap between the housing 21 and the rotor part 22, and thus improves the performance capability of the pressing-out apparatus 4.

The rotor part 22 has an axially extending connection 25, constricted analogous to an insertion end of a tool, for providing an operative coupling between the motor 3 (see FIG. 1) of a drilling device and the rotor part 22. At the opposite end of the pressing-out apparatus 4, the rotor part 22 has a receptacle 26 for producing an operative coupling between the anchor tube 5 of the composite anchor 2 and the rotor part 22. In order to improve cooperation between the rotor part 22 and the anchor tube 5, the anchor tube has a projection 30 adjacent its trailing end 8 serving as engagement means or load application means for the receptacle 26.

An inner tube serving as a receptacle 31 for the mass 32 to be pressed out is provided in the anchor tube 5 of the composite anchor 2. The mass 32 to be pressed out is packaged in a foil bag and is arranged in the anchor tube 5 with the pressing-out member 33 on the working side in the factory or before the pressing-out apparatus 4 is mounted on the anchor tube 5.

The pressing device 24 has an inlet opening 36, an intermediate channel 37 and an outlet opening 38 for the water used as the fluid medium. The intermediate channel 37 and the outlet opening 38 lie on an axis 43 of the pressing device 24. The inlet opening 36 extends perpendicular to the axis 43, radial to the outer surface of the pressing device 24. An annular channel 39 which is broken up into sections, for example, is provided in the rotor part 22 and enables communication between a connection opening 40 in the housing 21 and the inlet opening 36 in the pressing device 24 in different rotational positions of the rotor part 22. A coupling portion 41 having a pressure relief valve 42 is provided in the region of the connection opening 40, for example, for connecting a hose which carries the fluid medium to the pressing device 24.

In the region of the outlet opening 38, the pressing device 24 has a mandrel 46 which can be slid into the inner tube which is constructed as a receptacle 31. In order to ensure the seal between the receptacle 31 and the mandrel 46, the mandrel provided with a circumferentially extending groove 47 and a sealing ring 48 arranged in the groove.

The inner tube serving as receptacle 31 for the mass 32 to be pressed out is arranged eccentrically with respect to the cross section of the anchor tube 5 to provide a removal channel 51 in the anchor tube 5. The pressing device 24 likewise has a removal channel 52 which communicates with the removal channel 51 in the anchor tube 5 and with a removal channel 53 in the rotor part 22. The removal channels 51, 52 and 53 allow drillings to be sucked out when using a dry drilling process and allow flushing water to be supplied and removed when a wet drilling process is used.

The invention claimed is:

1. Apparatus for pressing out a mass (22) from an axially extending self-drilling chemical composition anchor (2) for use in a construction field such as for mining and tunnel construction, comprising an axially extending outer housing (21) with an axially extending pressing device (24) within said housing (21), said composite anchor (2) comprises an axially extending anchor tube (5) having a leading end (6) with a drilling head (7) and a trailing end (8) within said outer housing (21) and arranged to be driven into a receiving material by a motor (3), said anchor tube (5) has a receptacle (31) therein for the mass (32) to be pressed out from the anchor tube (5), a piston (33) within said anchor tube (5) for pressing out the mass (32) from the receptacle (31), and the apparatus (4) for pressing out the mass (22) is operatively coupled with said motor (3) and said trailing end (8) of said anchor tube (5), whereby said pressing device (24) is actuated by a fluid medium and said pressing device (24) has an inlet opening (36), an intermediate channel (37) and an outlet opening (38) for the fluid medium, and said pressing device (24) comprises a removal channel for removal of drillings generated during the drilling operation of said composite anchor (2).

2. An apparatus for pressing out a mass (32), as set forth in claim 1, wherein said apparatus (4) for pressing out the mass (32) comprises a rotatably mounted rotor part (22) located within said housing (21) and said rotor part (22) is operatively coupled to said motor (3) and to the trailing end (8) of said anchor tube (5), and wherein said rotor part (22) comprises a removal channel (52, 53) for removal of drillings generated during the drilling operation of said composite anchor (2).

3. An apparatus for pressing out a mass (32), as set forth in claim 2, wherein said pressing device (24) is located inside said rotor part (22).

4. An apparatus for pressing out a mass (32), as set forth in claim 2, including a removal channel (51) extending axially from said removal channel (52, 53).

5. An apparatus for pressing out a mass (32), as set forth in claim 1 wherein said fluid medium is water.

6. An apparatus for pressing out a mass (32), as set forth in claim 1 wherein said intermediate channel (37) and said outlet opening (38) lie substantially on an axis (43) of said pressing device (24) and said inlet opening (36) is arranged radially outwardly relative to said axis (43).

7. An apparatus for pressing out a mass (32), as set forth in claim 6, wherein said pressing device (24) has a mandrel (46) in the region of the outlet opening (38) and is inserted into said receptacle (31) in said anchor tube (5).

8. An apparatus for pressing out a mass (32), as set forth in claim 7, wherein a sealing means (48) is arranged between said mandrel (46) and the said receptacle (31) of said anchor tube (5) for providing a tight connection therebetween.

9. An apparatus for pressing out a mass (32), as set forth in claim 1 wherein a connection opening (40) extends through said housing (21) of said apparatus (4) for communication with said inlet opening (36) of said pressing device (24).

10. An apparatus for pressing out a mass (32), as set forth in claim 9, wherein a pressure relief valve (42) is connected to said pressing device (24) adjacent to said connection opening (40).

* * * * *